US005730520A

United States Patent [19]

Hsu et al.

[11] Patent Number: 5,730,520

[45] Date of Patent: Mar. 24, 1998

[54] SELECTIVELY ACTUABLE LIGHTING SKATE WHEEL

[76] Inventors: Chi-Hsueh Hsu, No. 11, Shih Chien 4th Village, Feng Shan Shih, Kaohsiung Hsien; Chi-Yeh Hsu, 4F, No. 144, Chu-Lin Road, Yung-Ho Shih, Taipei Hsien; Jong-Yes Hsu, No. 31, Lane 32, Chiang Nan 10th Street, Tao Yuan Shih, all of Taiwan

[21] Appl. No.: 606,726

[22] Filed: Feb. 27, 1996

[51] Int. Cl.[6] ..... B60Q 1/00; F21L 15/08; A63C 17/26

[52] U.S. Cl. ..... 362/78; 362/61; 362/103; 362/800; 362/802

[58] Field of Search ..... 362/78, 61, 35, 362/800, 802, 103; 280/811, 11.9, 809; 301/5.3

[56] References Cited

U.S. PATENT DOCUMENTS

| | | | |
|---|---|---|---|
| 3,789,208 | 1/1974 | Lewis | 362/103 |
| 4,298,910 | 11/1981 | Price | 362/103 |
| 4,363,502 | 12/1982 | Bakerman | 362/103 |
| 4,367,515 | 1/1983 | Beard | 362/226 |
| 4,383,244 | 5/1983 | Knauff | 362/78 |
| 4,800,469 | 1/1989 | Leon | 362/78 |
| 5,294,188 | 3/1994 | Vancil, Jr. | 362/78 |
| 5,313,188 | 5/1994 | Choi et al. | 362/800 |
| 5,327,329 | 7/1994 | Stiles | 362/61 |
| 5,456,478 | 10/1995 | Hsu et al. | 362/78 |
| 5,475,572 | 12/1995 | Tseng | 362/802 |
| 5,552,971 | 9/1996 | Madden | 362/103 |
| 5,552,972 | 9/1996 | Rezvani | 362/78 |
| 5,580,092 | 12/1996 | Hsu et al. | 362/78 |
| 5,580,093 | 12/1996 | Conway | 362/78 |
| 5,649,716 | 7/1997 | Zhang | 362/78 |
| 5,653,523 | 8/1997 | Roberts | 362/800 |

*Primary Examiner*—Ira S. Lazarus
*Assistant Examiner*—Matthew Spark
*Attorney, Agent, or Firm*—Morton J. Rosenberg; David I. Klein; Jun Y. Lee

[57] ABSTRACT

The present invention relates to a power saving apparatus of an in-line skate lighting wheel wherein a switch is provided through which a circuit is shifted either to a ready condition or to an off condition depending on need; when said circuit is shifted to said ready condition, said lighting wheel under movement can flicker; while, when shifted to said off condition, power of batteries of said lighting wheel won't be consumed.

3 Claims, 5 Drawing Sheets

SELECTIVELY ACTUABLE LIGHTING SKATE WHEEL

BACKGROUND OF THE INVENTION

Field of the Invention

The present invention relates generally to a lighting wheel for an in-line skate, such as shown in FIG. 10 and disclosed in patent application, Ser. 08/309,977, filed in the United States Patent and Trademark Office on Sep. 20, 1994, which emits light during use of the in-line skate.

Such a prior art lighting wheel shown in FIG. 10 is known to have a disadvantage in that it emits light whenever it is moved, even when the in-line skate is being used in the daytime, or even when the in-line skate is simply being transported. It, therefore, consumes the power of its batteries unnecessarily, thereby rendering itself not economical.

SUMMARY OF THE INVENTION

The present invention relates to a power saving measure which comprises a switch coupled to a circuit board fitted within an in-line lighting skate wheel.

The circuit board comprises a flickering circuit, a power source formed by a plurality of batteries, an oscillating switch, and a plurality of light emitters. When the flickering circuit is activated by the oscillating switch responsive to the movement of the given skate wheel, it energizes the light emitters to flicker.

A primary switch is provided for setting the flickering circuit to either a ready state or an off state. When the flickering circuit is in its off state, it is not activated by the oscillating switch so as not to consume battery power. Only when the flickering circuit is in its ready state is the flickering circuit activated by the oscillating switch upon the skate wheel's movement to energize the flickering of the light emitters.

As a first embodiment of the switch, two legs of the switch are connected to a terminal of the flickering circuit and the battery, respectively, such that upon connecting the legs with a conductor, the flickering circuit is toggled between its off and ready states. In a second embodiment, two legs of the switch are connected to a power input end of the flickering circuit and the battery, respectively, such that upon covering the legs with a conductive cover, the flickering circuit is placed in its ready state, while upon removing the conductive cover, the flickering circuit is returned to its off state. In a third embodiment, two legs of the switch are connected to a terminal of the flickering circuit and the battery, respectively, such that upon pushing one of the legs to momentarily contact the other leg, the flickering circuit is toggled between its off and ready states. The leg to be pushed in that embodiment is resilient. In a fourth embodiment, the switch is realized as a push button assembly formed with two legs respectively connected to a terminal of the flickering circuit and the battery such that upon pushing of the push button, the flickering circuit is toggled between its off and ready states. In a fifth embodiment, the switch is provided with a thin resilient conductor and a contact point respectively connected to a terminal of the flickering circuit and the battery such that upon pushing the thin resilient conductor against the contact point, the flickering circuit is toggled between its off and ready states. The thin resilient conductor is biased to remain apart from the contact point when not pushed.

In utilizing in-line skates equipped with the lighting wheels of the present invention, the user can selectively place the flickering circuit to its ready state so that the light emitters of the lighting wheels flicker when the user actuates the oscillating switch by skating. To prepare for transporting the in-line skates, the user can selectively place the flickering circuit to its off state such that battery power is not wasted.

BRIEF DESCRIPTION OF THE DRAWINGS

The invention will be better understood by reference to the accompanying Drawings, wherein.

DESCRIPTION OF THE PREFERRED EMBODIMENTS

Figure 1:
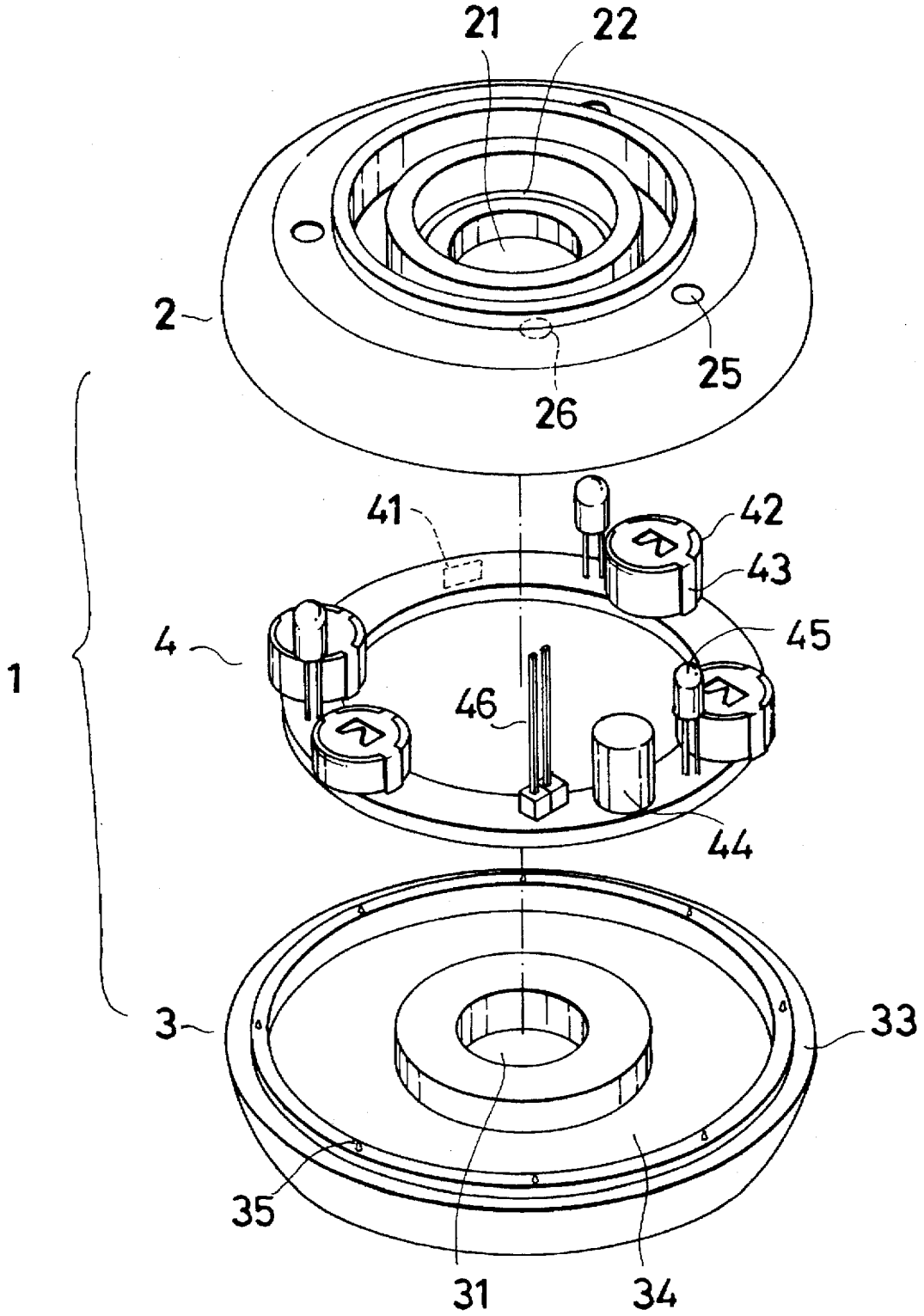
FIG. 1 is an exploded perspective view of a selectively actuable lighting wheel of the present invention.
Figure 2:
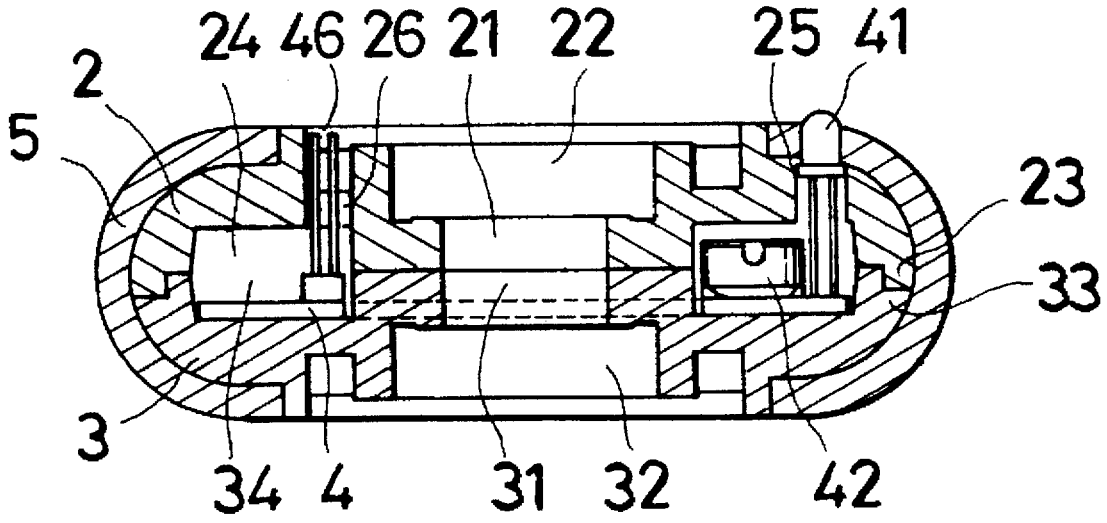
FIG. 2 is a cross-sectional view of a selectively actuable lighting wheel of the present invention.
Figure 3:
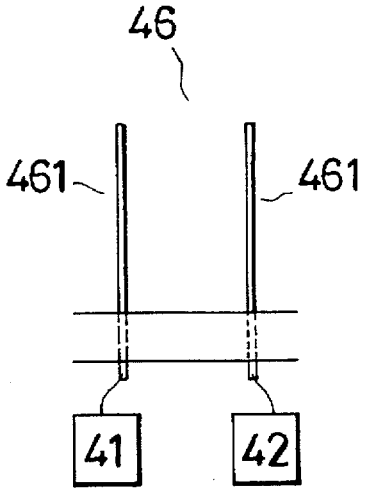
FIG. 3 is a schematic view showing a first embodiment of a primary switch of the present invention.

Referring to FIGS. 1, 2, and 3, there is shown an embodiment of the selectively actuable lighting skate wheel of the present invention which comprises a primary switch 46 mounted to a circuit board 4 of a lighting wheel 1. The circuit board 4 is shaped as a ring and comprises a flickering integrated circuit chip 41, a plurality of battery housings 43 housing power source batteries 42, an oscillating switch 44, and a plurality of light emitters 45. When the flickering circuit 41 is activated by the oscillating switch 44 upon movement of the wheel 1, flickering circuit 41 energizes the light emitters 45 to flicker.

The lighting wheel 1, as shown in FIG. 1, comprises the circuit board 4 and two body portions 2, 3. The body portion 3 has a round trench 32 formed in its outer side and a holding recess 34, a rim 33, as well as a plurality of melt couplings 35 formed on its inner side. The body portion 3 is formed with a through hole 31.

The body portion 2 has a round trench 22 formed in its outer side and a rim 23 and a holding recess 24 formed in its inner side. Openings 25, 26 and a through hole 21 are also formed in the body portion 2.

The body portions 2, 3 capture the circuit board 4 between their holding recesses 24, 34 and are firmly affixed to one another by the melt couplings 35 which are melted with a supersonic wave. The openings 25, 26 allow the passage of the light emitters 45 and the switch 46 therethrough for access outside the wheel. The round trenches 22, 32 are used to each hold a ball bearing pack 6 shown in FIG. 8. The wheel assembly is covered by an elastic coating 5, such as polyurethane, circumferentially applied about the joints of the body portions 2, 3.

The primary switch 46 is to be controlled by the user to place the flickering circuit 41 in either a ready state or an off state. When the flickering circuit 41 is in its off state, it is disabled from activation by the oscillating switch 44 and, therefore, cannot consume power of the batteries 42. The flickering circuit 41 may be enabled for activation by the oscillating switch 44 upon the movement of the wheel 1 so as to energize the light emitters 45 to flicker by appropriate setting of the primary switch 46 to place the flickering circuit 41 in its ready state.

In a first embodiment of the primary switch 46 shown in FIG. 3, two legs 461, 461 of the switch 46 are connected to a terminal of the flickering circuit 41 and the battery 42, respectively, such that upon forming a connection across the legs 461, 461 with a conductor (not shown), the flickering circuit 41 is toggled between its off and ready states.

Figure 4:
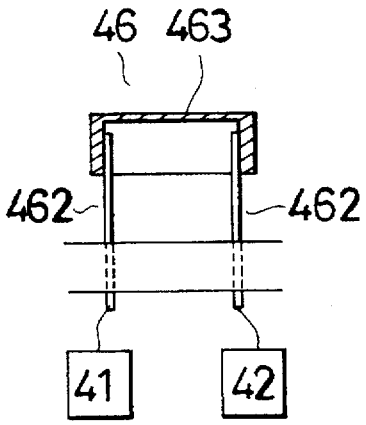
FIG. 4 is a schematic view showing a second embodiment of a primary switch of the present invention.

A second embodiment of the switch 46 is shown in FIG. 4. In that embodiment, two legs 462, 462 of the switch 46 are connected to a power input end of the flickering circuit 41 and the battery 42, respectively, such that upon covering the legs 462 with a conductive cover 463, the flickering circuit 41 is placed in its ready state, while upon removing the conductive cover 463, the flickering circuit 41 is returned from its ready state to its off state.

Figure 5:
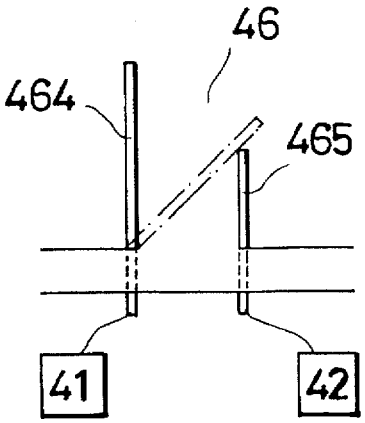
FIG. 5 is a schematic view showing a third embodiment of a primary switch of the present invention.

Referring to FIG. 5, there is shown a third embodiment of the switch 46. In that embodiment, legs 464, 465 of the switch 46 are connected to a terminal of the flickering circuit 41 and the battery 42, respectively, such that upon pushing the leg 464 to momentarily contact the leg 465, the flickering circuit 41 is toggled between its off and ready states. The leg 464 is formed of a resilient material.

Figure 6:
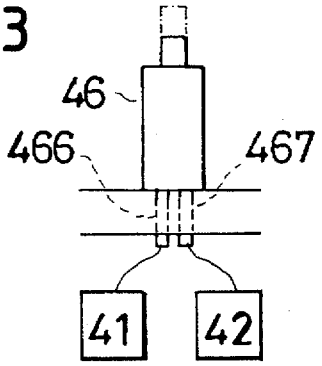
FIG. 6 is a schematic view showing a fourth embodiment of a primary switch of the present invention.

Referring to FIG. 6, there is shown a fourth embodiment of the switch 46. In that embodiment, the switch 46 is formed as a push button assembly 46 having two legs 466, 467 respectively connected to a terminal of the flickering circuit 41 and the battery 42. Upon the user's pushing the push button 46, the flickering circuit 41 is toggled between its off and ready states.

Figure 7:
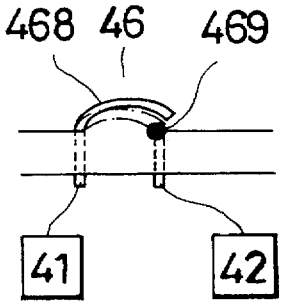
FIG. 7 is a schematic view showing a fifth embodiment of a primary switch of the present invention.

Referring to FIG. 7, there is shown a fifth embodiment of the switch 46. In that embodiment, the switch 46 is provided with a thin resilient conductor 468 and a contact point 469 respectively connected to a terminal of the flickering circuit 41 and the battery 42 such that upon the user's pushing the thin resilient conductor 468 to bear against the contact point 469, the flickering circuit 41 is toggled between its off and ready states. The thin resilient conductor 468 is biased away from engagement with the contact point 469 when not pushed by the user.

Figure 8:
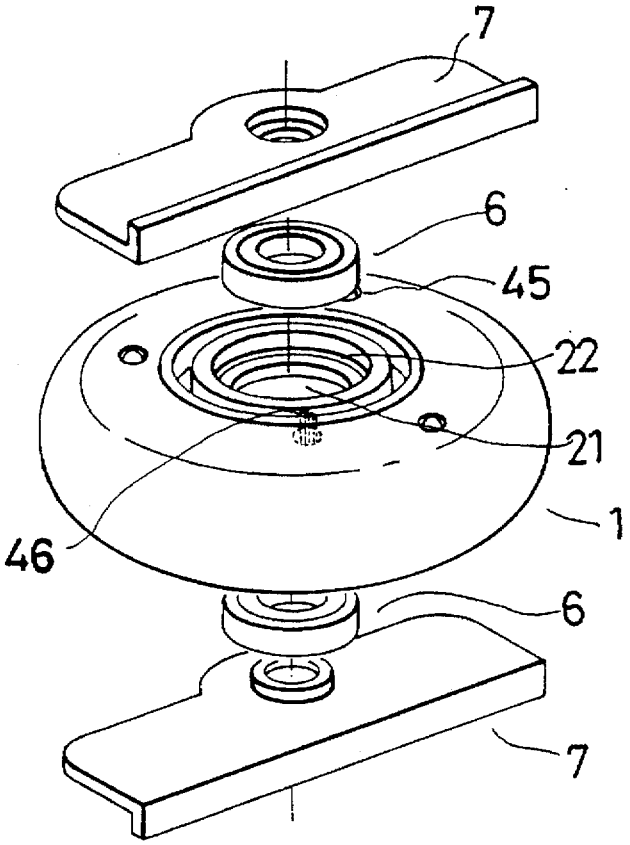
FIG. 8 is an exploded perspective view showing the assembly of parts necessary for coupling the selectively actuable lighting wheel to an in-line skate.
Figure 9:
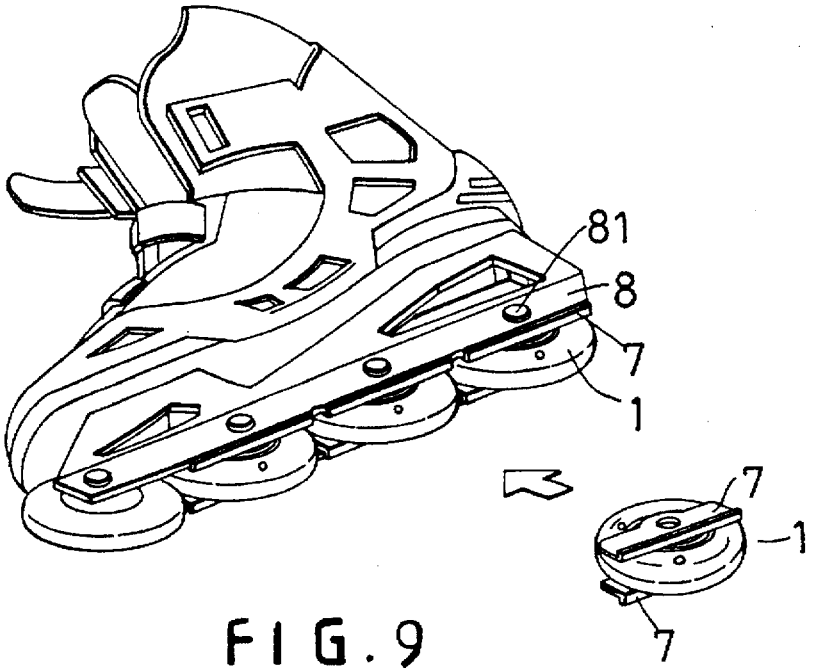
FIG. 9 is an illustrative perspective view showing an in-line skate fitted with selectively actuable lighting wheels of the present invention; and, FIG. 10 is a cross-sectional view of a prior art lighting wheel.
Figure 10:
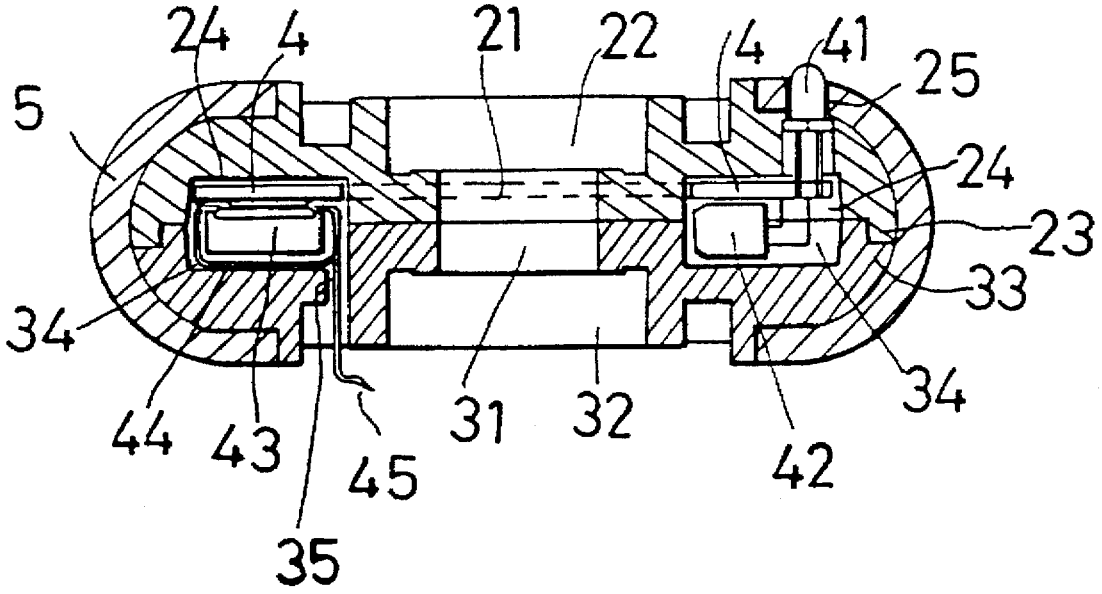
FIG. 10 (PRIOR ART)

Referring to FIGS. 8 and 9, the wheel 1 may be installed on an in-line skate which is typically equipped with a pair of longitudinal plates 8 extending along its sole, a plurality of holes (not numbered) being formed therethrough. The lighting wheel 1 can be coupled between the plates 8 by means of an axle 81, the axle 81 being placed through bent plates 7, through the wheel's axial holes 21, 31, and the holes of the longitudinal plates 8. A corresponding nut (not shown) or other suitable mechanism is coupled to one or both ends of the axle 81 to lock the coupling.

In utilizing in-line skates so equipped with selectively actuable lighting wheels 1 of the present invention, the user can selectively place the flickering circuit 41 in its ready state so that the light emitters 45 of the lighting wheels 1 are actuated by the oscillating switch 44 to flicker as the user skates. When the skates are not in use, such as when it is stored for transport, the lighting system of the skates may be disabled by appropriately setting the primary switch 46 to place the flickering circuit 41 to its off state so that power of the batteries 42 is not wasted.

From the above described, the selectively actuable lighting wheel 1 of the present invention can be seen to have the following advantages:

1. It provides a user-actuable switch 46, which can be controlled easily, and which, further, enables testing and quality control of the lighting wheel 1 to be conveniently performed.

2. The flickering circuit 41 can be placed in its off state to conserve power of the batteries 42 when lighting of the lighting wheel 1 is unnecessary.

While preferred embodiments of the invention have been described above, it will be recognized and understood that various modifications may be made therein, and the appended claims are intended to cover all such modifications which may fall within the spirit and scope of the invention.

What is claimed is:

1. A lighting skate wheel adapted for selective actuation by a user comprising:

(a) a skate wheel assembly including a wheel having at least an annular first portion, an annular second portion, and means coupled to said first and second portions for joining said first and second portions one to the other, said first and second portions being substantially coaxially joined to define an inner chamber therebetween, each of said first and second portions being adapted to support at least a portion of the weight of said user when said lighting skate wheel is in use;

(b) a circuit board disposed within said inner chamber of said wheel assembly to rotate therewith;

(c) a battery power source coupled to said circuit board;

(d) light emitting means coupled to said circuit board for emitting light upon energization thereof; and, (e) energization means coupled to said circuit board and said light emitting means for periodically energizing said light emitting means, said energization means including:

(1) a flickering circuit actuable between at least an enabled operational state and a disabled operational state;

(2) primary switch means coupled to said flickering circuit selectively actuable by said user to place said flickering circuit in one of said operational states thereof, at least a portion of said primary switch means extending through an opening in at least one of said first and second portions of said wheel assembly; and, (3) an oscillating switch coupled to said flickering circuit, said oscillating switch being adapted to activate said flickering circuit responsive to rotational movement of said wheel assembly when said flickering circuit is in said enabled operational state.

2. The lighting skate wheel as recited in claim 1 wherein said primary switch means includes a pair of conductive legs, said flickering circuit being adapted for toggling between said enabled and disabled operational states thereof upon conductive connection of said conductive legs.

3. The lighting skate wheel as recited in claim 1 wherein at least a portion of said primary switch means extends through said skate wheel assembly for selective manipulation by said user.

* * * * *